United States Patent [19]

Draper et al.

[11] 4,168,924

[45] Sep. 25, 1979

[54] PLASTIC REINFORCEMENT OF CONCRETE

[75] Inventors: Homer L. Draper; Duane W. Gagle, both of Bartlesville, Okla.

[73] Assignee: Phillips Petroleum Company, Bartlesville, Okla.

[21] Appl. No.: 819,925

[22] Filed: Jul. 28, 1977

[51] Int. Cl.[2] ..... E01C 11/16

[52] U.S. Cl. ..... 404/70; 404/45; 404/100; 404/134; 404/82; 52/581; 52/663; 52/414; 428/33; 428/255; 428/489

[58] Field of Search ..... 404/70, 17, 71, 82, 404/134, 36, 45, 72, 100, 132–135; 428/33, 52, 53, 255, 489; 52/309.1, 414, 581, 663, 660, 673

[56] References Cited

U.S. PATENT DOCUMENTS

| | | | |
|---|---|---|---|
| 887,674 | 5/1908 | Macintosh | 52/581 |
| 1,225,055 | 5/1917 | Ransome | 404/70 |
| 1,505,642 | 8/1924 | Henry | 404/18 |
| 2,078,485 | 4/1937 | Dunham | 404/70 X |
| 2,115,667 | 4/1938 | Ellis | 404/70 |
| 2,139,816 | 12/1938 | Fordyce | 404/70 |
| 2,406,559 | 8/1946 | Oakes | 52/581 X |
| 2,414,483 | 1/1947 | Okonski | 52/581 X |
| 2,686,344 | 8/1954 | Van De Veer | 52/663 X |
| 2,794,756 | 6/1957 | Leverenz | 52/309.6 X |
| 2,836,529 | 5/1958 | Morris | 52/309.16 X |
| 3,270,103 | 8/1966 | Kurtz | 52/309.7 X |
| 3,344,608 | 10/1967 | McEachran | 404/70 X |
| 3,482,567 | 12/1969 | Franklin | 428/255 X |
| 3,557,671 | 1/1971 | Vasiloff | 404/28 |
| 3,581,631 | 6/1971 | Samson | 428/489 X |
| 3,625,119 | 12/1971 | Gagle | 404/17 |
| 3,670,506 | 6/1972 | Gaudard | 404/17 |
| 3,909,144 | 9/1975 | Garn | 428/489 X |

FOREIGN PATENT DOCUMENTS

| | | | |
|---|---|---|---|
| 383848 | 11/1932 | United Kingdom | 404/70 |
| 386142 | 1/1933 | United Kingdom | 404/70 |

*Primary Examiner*—Nile C. Byers, Jr.

[57] ABSTRACT

Reinforced concrete is prepared by embedding within it a reinforcing element of at least one rigid plastic gridwork (which is optionally filler reinforced) of integrally molded struts.

34 Claims, 7 Drawing Figures

PLASTIC REINFORCEMENT OF CONCRETE

FIELD OF THE INVENTION

This invention relates to reinforcement of concrete. In one aspect, it relates to a method of reinforcing concrete. In another aspect, it relates to an asphaltic concrete structure reinforced with rigid plastic gridwork.

BACKGROUND OF THE INVENTION

It is common for fatigue crack failures to occur in concrete which is subjected to repetitive high stresses. An important problem is how to produce a reinforced concrete having the combination of very high dynamic fatigue resistance, as well as other desirable properties such as excellent resistance to breaking of the bond between the concrete and the reinforcing element. This problem is particularly important in the design of aircraft landing strips which will be subjected to high impact forces, or wherever great and sudden forces must be sustained by a surface without failure. The present invention addresses this problem.

It has long been known to insert metal into fabrications of cementitious materials. Rigid metal frameworks inserted into asphaltic concrete do not provide a good solution to the problem addressed here because the metal tends to exhibit different thermal properties than the asphaltic concrete, resulting in cracks or failures of the concrete.

Inserting very flexible structures into asphaltic concrete also does not solve the problem because a very flexible structure will not give sufficient strength to the concrete.

Such prior art reinforcements of surfaces have not adequately solved the problem of providing excellent dynamic fatigue crack resistance.

The present invention, on the other hand, provides an excellent solution to the problem of producing a reinforced concrete for use where repetitive high stresses must be sustained.

It is an object of this invention to provide an improved method of reinforcing concrete. It is a further object of this invention to provide a reinforced concrete which will have high resistance to failure under large and repetitive stresses.

STATEMENT OF THE INVENTION

According to the invention a concrete structure is formed by pouring a first layer, placing a gridwork of plastic molded struts on the fresh unhardened top surface of the first layer, and then pouring a second layer covering the gridwork. In this application, the word plastic means a synthetic polymeric substance.

PREFERRED EMBODIMENTS OF THE INVENTION

Figure 1:
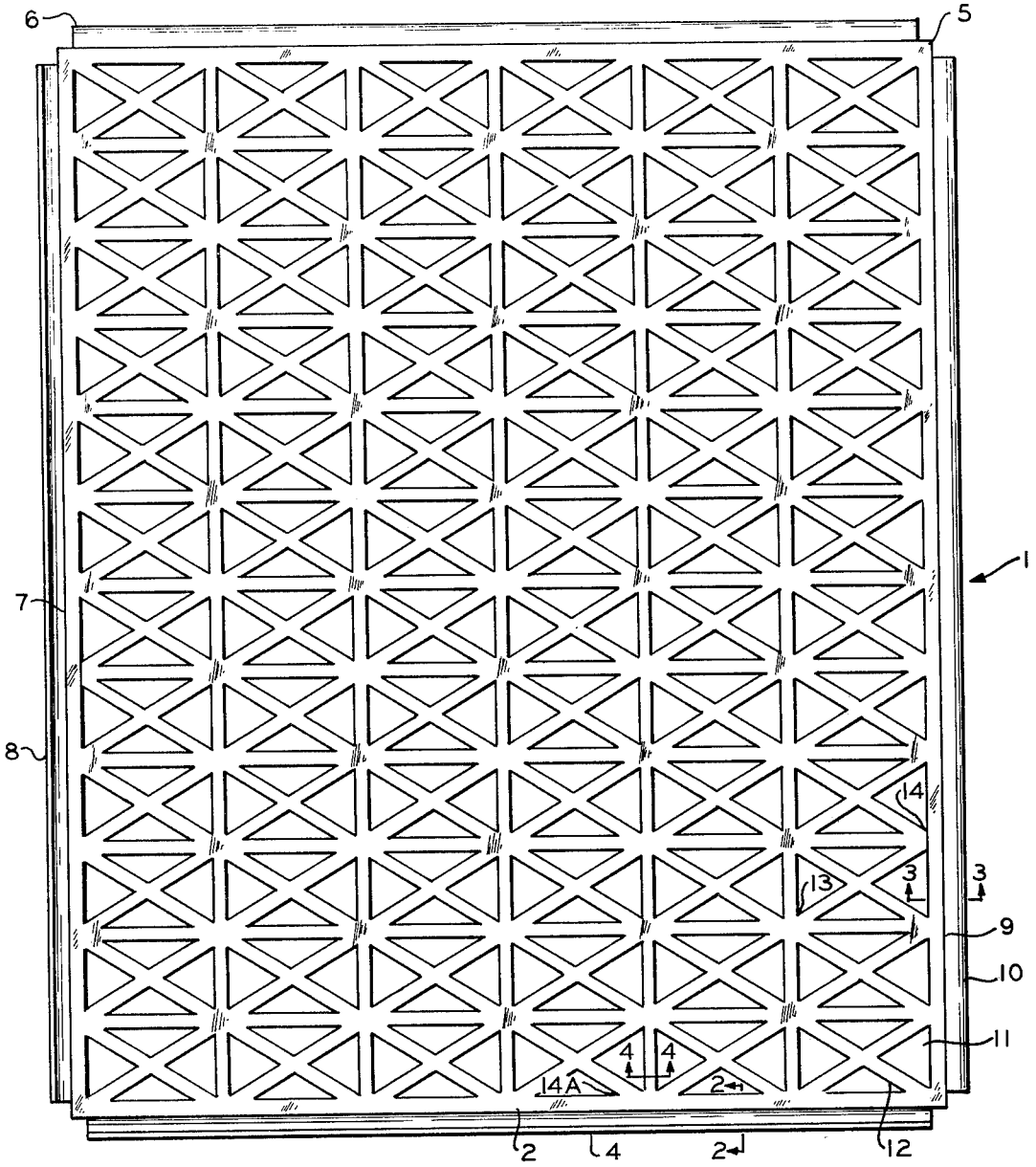
FIG. 1 is a plan view of a gridwork unit of reinforcing plastic for use in the invention.
Figure 2:
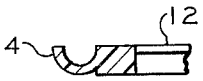
FIG. 2 is a sectional view along the lines 2—2 of FIG. 1 showing an upturned ridge for fastening two gridworks together.
Figure 4:
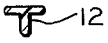
FIG. 4 is a sectional view along the lines 4—4 of FIG. 1, illustrating the T-shaped cross section of a strut of the reinforcing plastic structure.
Figure 3:
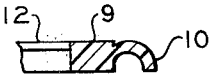
FIG. 3 is a sectional view along the lines 3—3 of FIG. 1 showing a downturned ridge for cooperating with an upturned ridge.

Referring to the drawings, a plastic gridwork unit generally referred to as 1 is formed of a rectangular frame having one end 2 with an upturned interlocking groove 4, and a first side 9 with a downturned groove 10. Second end 5 has a downturned interlocking grove 6 similar to groove 10 and second side 7 has an upturned groove 8 similar to groove 4. Unit 1 also has triangular openings 11, struts 12 having a T-shaped cross section and which are integrally molded to each other at the intersections 13 and to side 9 as at 14 and to end 4 as at 14A. Since the side interlocking grooves 8, 10 and 4, 6 turn in opposite directions respectively, adjacent gridwork units can be made to interlock to form a continuous reinforcing element.

Figure 5:
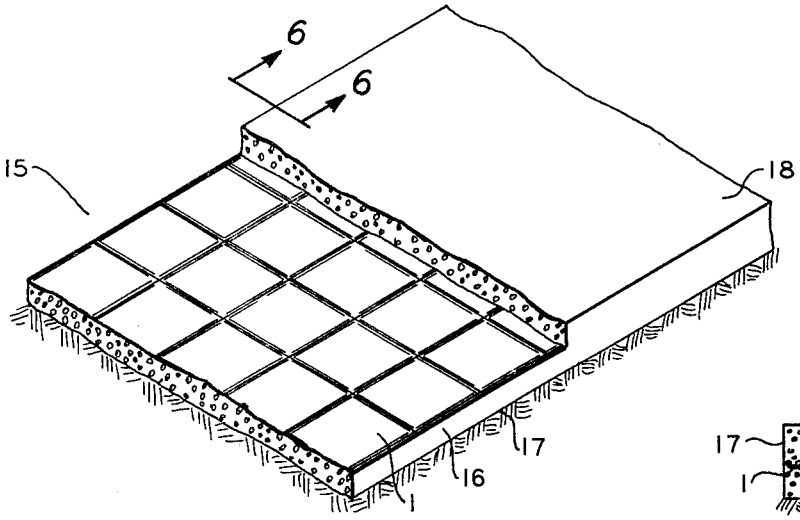
FIG. 5 is a pictorial view partly in cross section of an asphalt road constructed using a plurality of gridwork units as the reinforcing element for the road.
Figure 6:
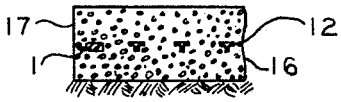
FIG. 6 is a sectional view along the lines 6—6 of FIG. 5, illustrating the T-shaped cross section of struts of the reinforcing plastic structure.

Now referring to FIGS. 5 and 6, the roadway is generally referred to as 15. A plurality of plastic gridwork units 1 are illustrated in interlocking relationship on a first layer of asphaltic concrete 16 which is laid on a roadbed 17. A second layer of asphaltic concrete 18 is laid over the reinforcing plastic element formed by the plurality of interlocking gridwork units.

Preferably, the plastic gridwork is placed on the first layer of concrete while the concrete is at a high enough temperature to soften the plastic sufficiently to cause bonding of the plastic to the concrete when the concrete cools. Similarly, the upper layer is poured at a high enough temperature to soften the plastic sufficiently to cause bonding. In this way the maximum reinforcing benefit is obtained from the gridwork.

Although the invention is applicable broadly to concrete structures, including hydraulic concrete, it is particularly applicable to use with asphaltic concrete. Such material usually is about 5 to about 7 weight percent asphalt and about 93 to about 95 weight percent aggregate. These materials are poured while hot and thus it is relatively simple to get the desired softening and bonding.

Preferred materials for use in the plastic gridwork are polymers of ethylene, such as ethylene homopolymers, and copolymers such as ethylenebutene and ethylenehexene copolymers which soften at relatively low temperatures, for example in the range of about 240° F. (115° C.) to about 260° F. (127° C.). Since asphaltic concrete often is poured at temperatures in the neighborhood of 300° F. (149° C.), for example about 275° to about 310° F., it can be seen that the desired softening and the resultant bonding can be obtained easily. A preferred material for maximum reinforcement is high density polyethylene. An example of a preferred polymer is an ethylene homopolymer having a melt index of 3.0 (ASTM-1238) and a density of 0.964 (ASTM D1505) sold by Phillips Petroleum Company under the trademark MARLEX EMN 6030.

However, other suitable plastic materials can be used, including, for example, nylon, polypropylene, polyester, and epoxy resins.

For best results, it is preferred that the gridwork be made of a material which has a coefficient of expansion equal to or greater than that of the concrete. Thus, when the bonding occurs at a temperature above expected operating temperatures, the concrete will be in compression during normal operating conditions, thus minimizing cracking of the concrete.

In the practice of the invention, the first layer of asphaltic concrete may be of the same composition as or of a different composition from that of the second layer of asphaltic concrete. For example, in the building of asphaltic concrete roads, it is often desirable to have larger pieces of aggregate in the first (or base) layer than in the second, in order to impart greater strength to the roadbead.

The thicknesses of the two layers of concrete are not critical to the practice of the invention. In general those thicknesses normally used with structures for the intended service are satisfactory. The lower layer and the reinforcing unit should be designed so that the lower portion of the vertical bar of the T-shaped cross section is completely embedded in the concrete and the upper layer should be thick enough to completely cover the remaining part of the unit and provide the desired thickness of the wearing surface.

The asphaltic concrete layers may also be of different thicknesses. For example, one can first pour approximately a four-inch (10.16 cm.) base layer with relatively large aggregate, then place the plastic gridwork units onto the base layer, and then cover the gridwork units by approximately a two-inch (5.08 cm.) layer of a relatively smooth composition of asphaltic concrete.

On the other hand, for road structures designed to be subjected to very heavy impact loads, such as for airport landing runways, for example, it may be desired to use about three to about four inches of asphaltic concrete in the surface layer and about 6 (15.24 cm.) to about 8 (20.32 cm.) inches in the base layer.

Although the invention contemplates using a structure of a plurality of alternating concrete and gridwork layers, generally only two layers of asphaltic concrete and one layer of a reinforcing element of plastic gridwork units will be used because using multiple layers usually increases costs without a corresponding increase in resistance to failure.

It is preferred that each layer of asphaltic concrete be approximately uniformly thick throughout its major extent, as well as monolithic, for best dynamic fatigue crack resistance. It is recommended that the plastic gridwork be placed approximately midway between the top and bottom surfaces to give the best results.

A preferred configuration of the plastic gridwork units is one with integrally molded struts in a triangular pattern. For best results each strut is straight in the plane of the structure, although it may be desirable to have curved fillets at strut intersections. Fillers are preferably used in the plastic preparations to give added strength to the plastic itself. Useful fillers includes carbon black, fiberglass, asbestos, combinations of carbon black and fiberglass, and other filler materials as known in the art. Amounts of fillers used will generally be within the range of from about 0 to about 20 weight percent of the plastic.

The gridwork units may be heat fused together to form a larger grid for reinforcing the entire area of the concrete structure, but they are preferably interlocked together as described above to form the continuous reinforcing element before the upper layer of the structure is poured. Alternatively, they may be placed separately but adjacent to one another within the concrete.

The molded gridwork can be of any thickness for proper reinforcement, but generally the thickness will be in the range of from 0.250" (0.635 cm.) to 1" (2.54 cm.). The length and width dimensions of the gridwork units should be such that they can be easily handled but are limited only to the capacity of the injection molding machine in which they are fabricated. A size that can be easily handled is 2' (60.9 cm.)×2'6"(76.2 cm.).

As noted above, the cross-sectional configuration of each rigid strut is preferably T-shaped for improved strength of the molded unit. The T-shape is preferred also because it can be easily injection molded into a gridwork pattern.

The geometric pattern in the gridwork can be either regular (i.e., composed of regularly repeating units) or irregular. However, for better uniformity of support strength, a regular geometrical pattern is preferred. A regular geometric pattern composed of triangles is most preferred, again for reasons of support strength.

In the following examples, specimens of the inventive plastic reinforced asphaltic concrete and of controls containing metal reinforcement and no reinforcement material were subjected to both static load and dynamic flex tests.

Asphalt briquette specimens were prepared in a mold 20" (50.8 cm.)×12" (30.5 cm.)×2" (5.08 cm.) with surface type asphaltic concrete mix containing 4.6 weight percent asphalt, 85/100 penetrations (ASTM D-946-74) and aggregate having a maximum size of 0.375" (0.95 cm.). The mixture was compacted with a total load of 1500 lbs. in a Baldwin Test Machine. After curing 24 hours, the molded section was cut with a masonry saw into four specimens each having dimensions 12"×5"×2". Reinforcement materials (when used) had outside dimensions 5"×12" and were placed about midway between the bottom and top surfaces of the asphaltic concrete (at a depth of about 1" (2.54 cm.). For both the static and dynamic tests, polyethylene gridworks were embedded in asphatlic concrete. These gridworks were made of high-density polyethylene in the form of a section of the center portion of the bottom of trays made in accordance with U.S. Pat. No. 3,494,502. The T-shaped members had a cross bar about 0.250" (0.635 cm.) wide×0.120" (0.30 cm.) thick and a vertical leg 0.060" (0.15 cm.) thick and an overall height of 0.375" (0.95 cm.). The "T" shaped struts were integrally molded at their intersections and formed adjacent isosceles triangles having a base of about 2" (5.08 cm.) and sides of about 1.5" (3.81 cm.).

EXAMPLE I

Static Test

Specimens were prepared in the manner described above and were individually placed on two steel fulcrums which were 9 inches apart between centers and which had a supporting surface 1.25" wide with a slight inward taper. A load was applied on the top center of each specimen with a Baldwin Test Machine using a steel shoe 4" (10.2 cm.) long, 2" (5.08 cm.) wide, with a 7.5" (19.05 cm.) radius simulating the curvature of a 15" (38.1 cm.) diameter wheel. The load required for failure (i.e., the yield point) was measured with the Bladwin Test Machine. Both fine and coarse steel mesh were used to reinforce control asphaltic concretes in the static test. The results of the static load beam test are shown in Table I.

TABLE 1

Static Load Beam Test of Asphaltic Concrete

| Sample | Yield Point (lb) | Deflection (in.) |
|---|---|---|
| (Reinforcing material) | | |
| No reinforcement | 125 (56.62 Kgs.) | 0.03 (0.08 cm.) |
| Coarse welded steel wire mesh (6 in. (15.24 cm.) ×6 in. ×10 ga. wire | 170 (77.01 Kgs.) | 0.06 (O.15 cm.) |
| Fine welded steel wire mesh (1 in. (2.54 cm.) ×2 in. (5.08 cm.) × 12 ga. wire | 175 (79.27 Kgs.) | 0.06 (0.15 cm.) |
| Plastic mesh (rigid gridwork, unfilled) | 215 (97.39 Kgs.) | 0.30 (0.76 cm.) |

The results in Table I clearly show the superior resiliency and higher yield point of the inventive plastic reinforced asphaltic concrete as compared with the prior art steel reinforced asphaltic concrete and unreinforced asphaltic concrete.

EXAMPLE II

Dynamic Test

Table II shows the results of the dynamic fatigue tests on samples of asphaltic concrete, both with and without reinforcement.

Again, gridwork sections cut from the center portion of bakery trays were embedded in asphaltic concrete in the inventive specimens, the plastic samples having contained amounts of fiberglass filler varying from 0 to 20 weight percent. The size of the plastic gridworks tested was 5 in. (12.7 cm.)×12 in. (30.48 cm.)×0.375 in. (0.95 cm.).

Controls that were tested in the dynamic fatigue tests were asphaltic concrete with no reinforcement and with reinforcement of fine 1 in. (2.54 cm.)×2 in. (5.08 cm.)×12 ga. welded steel wire mesh.

Figure 7:
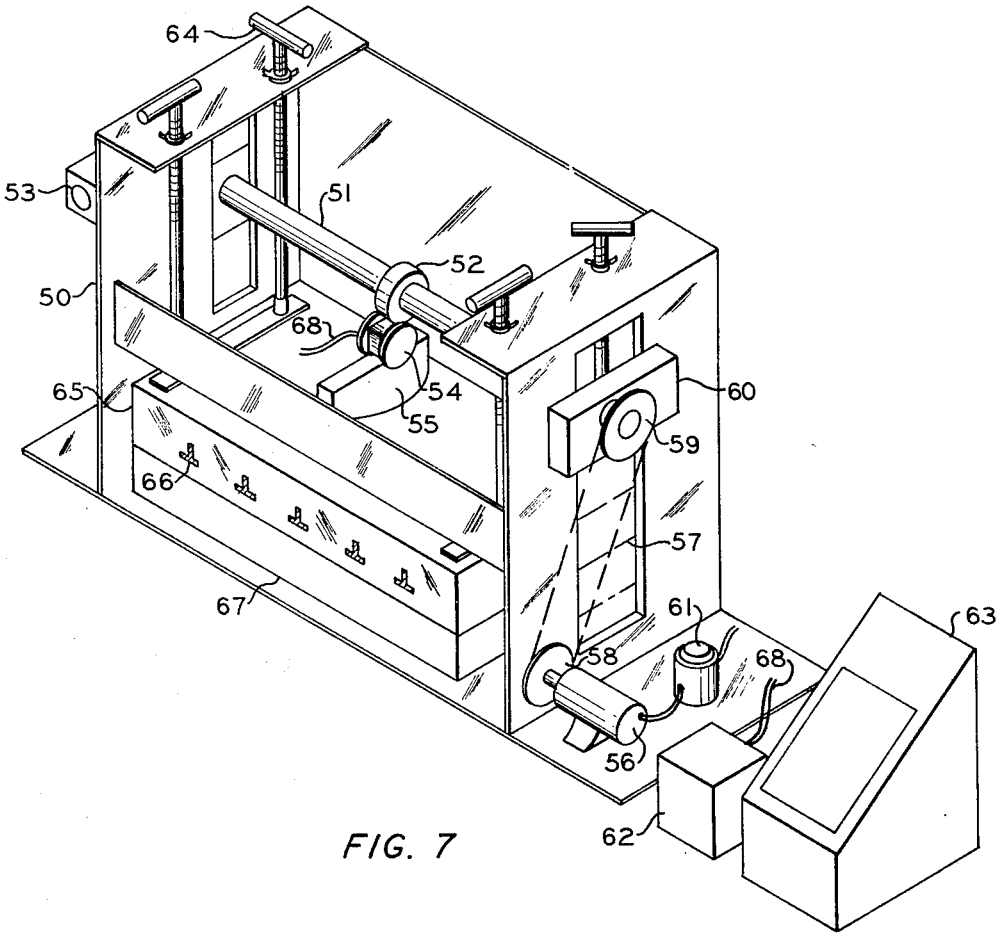
FIG. 7 is a partly schematic diagram of the apparatus used in the dynamic fatigue tests in Example II.

The machine used for the dynamic fatigue test is shown in FIG. 7. A frame 50 was 17" (43.18 cm.) high×14.5" (36.83 cm.) wide×9" (22.86 cm.) deep. A 1.5" (3.81 cm.) diameter steel shaft 51 was offset mounted in the upper section of the 9" ends, and a ball bearing 52 was press fit mounted at its center point. A revolution counter 53 was mounted at one end of the shaft 51. The ball bearing 52 contacted the top of a load cell 54 which was 2.375" (6.03 cm.)×2.375×1" (2.54 cm.) thick with a range of 0–10,000 psi (700 Kg/sq. cm.). The load cell 54 was mounted on a shoe 55 about 1" (2.54 cm.) wide×7.5" (19.05 cm.) deep and had a rounded bottom of 7.5" diameter to simulate a 15" (38.1 cm.) wheel. The shaft 51 mounted in bearing box 60 was driven by chain 57 and sprockets 58 and 59; and it was powered by a gear motor 56, which was a Dayton gear motor model 3M135, 1500 input RPM, 6 RPM output, 0.1 horsepower. A motor control 61 was used to control the speed of the motor. An amplifier 62 was used to amplify the signal of the load cell 54 transmitted through the wires 68 (partially shown). The amplifier 62 was a Brush Carrier preamplified model 13-4212-02. The recorder 63 which was used to record the cycles was a Brush Mark 200. An asphalt concrete specimen 65 having a grid 66 embedded therein was placed on a rubber base 67 which was 15.125 (38.4 cm.) wide×12.0" (30.38 cm.) long×3.75" (9.52 cm.) thick and was held down by hold down clamps 64.

The operation was as follows. Each 5"×12" specimen was individually placed on the rubber base, and the machine was set for deflection of 5/32" and speed of 14 cycles per minutes. The shoe attached to the machine was adjusted so as to strike the asphaltic concrete samples near their midpoints. As the off-center shaft rotated, it repeatedly deflected the load cell mounted above the shoe. The load cell then deflected the shoe; and the shoe deflected the specimen, which returned to its original position when the load was released. The load cell sent a signal to the amplifier which transmits to the recorder. The initial load was the highest. As the specimen was repeatedly deflected, it became weaker and the load described. The load force recorded was either at failure or (for the inventive specimens) when the test was terminated. A revolution counter mounted at the end of the shaft recorded the cycles.

The number of deflections of and effects on the asphaltic concrete samples were recorded and are shown in Table II. The rubber base simulated a weak base condition, which would be comparable to the earth base under a road.

TABLE II

Dynamic Fatigue Tests of Asphaltic Concrete

| Sample | Initial Deflection Load, lb. | Load Force, lb. | Cycles | Remarks |
|---|---|---|---|---|
| No reinforcement | 227 (102.83 Kgs) | 87 (39.41 Kgs) | 60 | Failed |
| Welded steel wire mesh reinforcement (Fine mesh, 1 in. × 2 in.) | 265 (120.04 Kgs) | 170 (77.01 Kgs) | 25 | Failed; bond failure also |
| Polyethylene, Plastic Tray Section, no filler | 244 (110.53 Kgs) | 146 (66.14 Kgs) | 500 | No failure |
| Polyethylene, Plastic Tray Section, 10% Fiberglass filler | 250 (113.25 Kgs) | 157 (71.12 Kgs) | 500 | No failure |
| Polyethylene, Plastic Tray Section, 15% Fiberglass filler | 274 (124.12 Kgs) | 186 (84.25 Kgs) | 500 | No failure |
| Polyethylene, Plastic Tray Section, 20% Fiberglass filler | 285 (129.1 Kgs) | 204 (92.41 Kgs) | 500 | No failure |

The results in Table II demonstrate the definitely superior dynamic fatigue crack resistance and resistance to bond failure of the inventive asphaltic concrete reinforced with a rigid plastic gridwork, as compared with asphaltic concrete reinforced with welded fine steel wire mesh and as compared with unreinforced asphaltic concrete.

The present invention is an excellent solution to the problem of achieving very high dynamic fatigue crack resistance in asphaltic concrete. By the practice of the invention, by embedding a plurality of interlocking rigid gridwork units, each unit formed of integrally molded plastic struts in asphaltic concrete, one can obtain a surface having not only the desired very high dynamic fatigue crack resistance (or resiliency) but also the additional very desirable properties of high static yield point, light weight, not tendency to rust, no restraining forces to cause cracks in the structure when the plastic chosen has equal or greater coefficient of thermal expansion than that of the concrete, and little or no tendency to separate from the asphaltic concrete. Furthermore, when the plastic struts themselves have a T-shaped cross section, the reinforcing gridwork (and the reinforced concrete) will have much greater strength then would a gridwork employing the same amount of plastic to form struts having simple round or rectangular shapes.

This invention has been described in detail for purposes of illustration, but it is not to be construed as limited thereby. Rather, it is intended to cover reasonable changes and modifications which will be apparent to one skilled in the art.

We claim:

1. A process for producing reinforced asphaltic concrete comprising (a) pouring a first layer of an asphaltic concrete, (b) placing plastic gridwork made of integrally molded synthetic polymer struts in a geometric pattern onto the fresh unhardened top surface of said first layer of asphaltic concrete, and (c) covering said plastic gridwork with a second layer of asphaltic concrete.

2. A process according to claim 1 wherein said geometric pattern is formed by regularly repeating units.

3. A process for producing reinforced concrete comprising (a) pouring a first layer of an asphaltic concrete, (b) placing plastic gridwork made of integrally molded synthetic polymer struts in a geometric pattern onto the fresh unhardened top surface of said first layer of asphaltic concrete, and (c) covering said plastic gridwork with a second layer of asphaltic concrete, wherein said geometric pattern is formed by regularly repeating units and wherein the cross sections of at least a portion of said integrally molded synthetic polymer struts of said platic gridwork are T-shaped.

4. A process according to claim 3 wherein said regular geometric pattern is composed of regularly repeating triangles.

5. A process according to claim 4, wherein said plastic is reinforced with a filler.

6. A process according to claim 5 wherein said filler is fiberglass.

7. A process according to claim 6 wherein the weight percentage of said fiberglass filler to said unfilled asphaltic concrete is in the range of about 0 to about 20.

8. A process according to claim 1 wherein said concrete is at a temperature higher than the melting point of said plastic gridwork when said gridwork is placed on and covered with said concrete.

9. A process according to claim 8 wherein said plastic support grids are made of plastic having a coefficient of expansion equal to or greater than that of said asphaltic concrete.

10. A process according to claim 9 wherein said plastic is a high-density polyolefin.

11. A process according to claim 10 wherein said high-density polyolefin is high-density polyethylene.

12. A process according to claim 8 wherein said first layer and said second layer of said asphaltic concrete are of about the same composition.

13. A process according to claim 8 wherein said first layer and said second layer of said asphaltic concrete have about the same thickness.

14. A process according to claim 1 wherein said plastic gridwork is obtained by injection molding.

15. A process according to claim 8 wherein the temperature of said asphaltic concrete is within the range of about 275° F. to 310° F., when said gridwork is placed onto and covered with said concrete.

16. A reinforced concrete prepared according to claim 1.

17. A reinforced concrete prepared according to claim 1 wherein 2 or more of said gridworks lie in one plane and are joined together end to end to form one large plastic layer.

18. An asphaltic concrete according to claim 17 wherein said gridworks are joined with use of interlocking grooves.

19. An asphaltic concrete according to claim 17 wherein said gridworks are joined with heat fusing.

20. A reinforced asphaltic concrete wherein a plastic gridwork made of integrally molded synthetic polymer support struts in a geometric pattern is embedded at the interface between a top layer and a bottom layer of said asphaltic concrete.

21. A reinforced asphaltic concrete according to claim 20 wherein at least a portion of said plastic support struts have a T-shaped cross section.

22. A reinforced asphaltic concrete according to claim 21 wherein said plastic is a high-density polyolefin.

23. A reinfored concrete according to claim 22 wherein said high-density polyolefin is high-density polyethylene.

24. A reinforced concrete according to claim 20 wherein said bottom layer and said top layer are of the same composition.

25. A reinforced concrete according to claim 20 wherein said bottom layer and said top layer have about the same thickness.

26. A reinforced concrete according to claim 20 wherein said plastic gridwork is obtained by injection molding.

27. A reinforced concrete according to claim 25 wherein the temperature of said asphaltic concrete is within the range from about 275° F. to about 310° F. when said gridwork is placed on and covered with said concrete.

28. A rectangular plastic reinforcing gridwork made of integrally molded synthetic polymer struts in a geometric pattern, wherein each of two adjacent sides of said gridwork has an upturned groove and each of the remaining two sides has a downturned groove.

29. A gridwork according to claim 28 wherein said geometric pattern is formed by regularly repeating geometric units.

30. A rectangular plastic reinforcing gridwork made of integrally molded synthetic polymer struts in a geometric pattern, wherein each of two adjacent sides of said gridwork has an upturned groove and each of the remaining two sides has a downturned groove, wherein said geometric pattern is formed by regularly repeating units and wherein the cross sections of at least a portion of said integrally molded synthetic polymer struts are T-shaped.

31. A gridwork according to claim 30 wherein said plastic is reinforced with a filler.

32. A gridwork according to claim 31 wherein said plastic is a high density polyolefin.

33. A gridwork according to claim 32 wherein the thickness of said gridwork is in the range of about 0.25 in. to about 1.0 in.

34. A reinforcing structure wherein two or more gridworks according to claim 28 are joined with use of interlocking grooves.

* * * * *

UNITED STATES PATENT AND TRADEMARK OFFICE

CERTIFICATE OF CORRECTION

PATENT NO. : 4,168,924

DATED : September 25, 1979

INVENTOR(S) : Homer L. Draper et al

It is certified that error appears in the above-identified patent and that said Letters Patent are hereby corrected as shown below:

Column 8, line 41, first line of claim 27, "25" should read --- 23 ---.

Signed and Sealed this

*Twenty-sixth* Day of *February 1980*

[SEAL]

*Attest:*

SIDNEY A. DIAMOND

*Attesting Officer*

*Commissioner of Patents and Trademarks*